US007513304B2

(12) United States Patent
Stayton

(10) Patent No.: US 7,513,304 B2
(45) Date of Patent: Apr. 7, 2009

(54) METHOD FOR DRILLING WITH IMPROVED FLUID COLLECTION PATTERN

(75) Inventor: Robert Joseph Stayton, The Woodlands, TX (US)

(73) Assignee: Precision Energy Services Ltd., Houston, TX (US)

( * ) Notice: Subject to any disclaimer, the term of this patent is extended or adjusted under 35 U.S.C. 154(b) by 70 days.

(21) Appl. No.: 10/557,573

(22) PCT Filed: Jun. 9, 2004

(86) PCT No.: PCT/US2004/018249

§ 371 (c)(1),
(2), (4) Date: Nov. 21, 2005

(87) PCT Pub. No.: WO2005/005763

PCT Pub. Date: Jan. 20, 2005

(65) Prior Publication Data

US 2006/0266517 A1 Nov. 30, 2006

Related U.S. Application Data

(60) Provisional application No. 60/476,964, filed on Jun. 9, 2003.

(51) Int. Cl.
*E21B 43/30* (2006.01)

(52) U.S. Cl. ..... 166/245; 166/50; 166/52

(58) Field of Classification Search ..... 166/245, 166/52, 50, 268, 272.7; 175/61, 62
See application file for complete search history.

(56) References Cited

U.S. PATENT DOCUMENTS 3,223,158 A * 12/1965 Baker ..... 166/259
4,390,067 A 6/1983 Willman
4,527,639 A 7/1985 Dickinson, III et al.
4,573,531 A 3/1986 Garkusha et al.
4,589,491 A * 5/1986 Perkins ..... 166/302
4,611,855 A * 9/1986 Richards ..... 166/50
4,776,638 A 10/1988 Hahn
5,074,360 A 12/1991 Guinn
5,074,365 A * 12/1991 Kuckes ..... 175/40
5,287,926 A 2/1994 Grupping
5,402,851 A 4/1995 Baiton
5,499,678 A 3/1996 Surjaatmadja et al.
5,690,390 A 11/1997 Bithell (Continued)

OTHER PUBLICATIONS

"Directional Drilling for Coalbed Degasification In Advance of Mining"; William P. Diamond and David C. Oyler; Proceedings of the 2nd Annual Methane Recovery from Coalbeds Symposium; Apr. 18-20, 1979.

(Continued)

*Primary Examiner*—Kenneth Thompson
(74) *Attorney, Agent, or Firm*—Wong, Cabello, Lutsch, Rutherford & Brucculeri, LLP

(57) ABSTRACT

A method for improving underground fluid collection and removal. The method includes drilling one well with a vertical section and a horizontal section having main bores and branches. All of the branches are substantially in one horizontal plane except one branch for each main bore. That one branch for each main bore is slope downward towards a common place, where a second vertical well is drilled for collecting fluid. A system resulting from the method is also claimed.

25 Claims, 7 Drawing Sheets

U.S. PATENT DOCUMENTS

| | | | | |
|---|---|---|---|---|
| 5,785,133 | A | 7/1998 | Murray et al. | |
| 6,357,523 | B1 | 3/2002 | Zupanick | |
| 6,561,288 | B2 | 5/2003 | Zupanick | |
| 6,604,580 | B2 | 8/2003 | Zupanick et al. | |
| 6,679,322 | B1 | 1/2004 | Zupanick | |
| 6,681,855 | B2 * | 1/2004 | Zupanick et al. | 166/268 |
| 6,964,298 | B2 | 11/2005 | Zupanick | |
| 6,976,533 | B2 | 12/2005 | Zupanick | |
| 2004/0108110 | A1 * | 6/2004 | Zupanick | 166/245 |

OTHER PUBLICATIONS

"Methane Control for Underground Coal Mines"; William P. Diamond; Bureau of Mines Information Circular; 1994.

"Directional Drilling for Coalbed Degasification—Program Goals and Progess in 1978"; David C. Oyler, et al.; Bureau of Mines Report of Investigations; 1979.

"Drilling a Horizontal Coalbed Methane Drainage System From a Directional Surface Borehole"; David C. Oyler and William P. Diamond; Bureau of Mines Report of Investigations; 1982.

"Drilling Long Horizontal Coalbed Methane Drainage Holes From a Directional Surface Borhole"; William P. Diamond and David C. Oyler; Society of Petroleum Engineers/Department of Energy Symposium on Unconventional Gas Recovery; May 18-21, 1980.

"Horizontal Drilling For Underground Coal Gasification"; Eric R. Skonberg, P.E. and Hugh W. O'Donnel, P.E.; Eight Underground Coal Conversion Symposium; Aug. 16, 1982.

"Horizontal & High Angle Air Drilling in the San Juan Basin, New Mexico"; Tim Dreiling, et al.

"Amoco's Horizontal & High Angle Air Drilling Program/San Juan Basin"; Tim Dreiling, et al.; The Brief; vol. 2, Issue 6; 1996.

"Lateral Drilling Technology Tested on UCG Project"; Patrick B. Tracy; IADC/SPE Drilling Conference; 1988.

"Complex Well Architecture, IOR, and Heavy Oils"; Gerard Renard, et al.; Oct. 1997.

"Conservation of Methane from Colorado's Mined/Minable Coal Beds: A Feasibility Study"; D.L. Boreck and M.T. Strever; Colorado Geological Survey, Department of Natural Resources; 1980.

* cited by examiner

METHOD FOR DRILLING WITH IMPROVED FLUID COLLECTION PATTERN

CROSS-REFERENCE TO RELATED APPLICATIONS

This application claims priority of a U.S. provisional patent application, Ser. No. 60/476,964, filed on Jun. 9, 2003, with the same title, by the same inventor.

BACKGROUND OF THE INVENTION

1. Field of the Invention

This invention relates to underground fluid (liquid and/or gas) collection and production, particularly to coal seam methane gas production and water drainage, and to an improved drainage pattern for gas and liquid collection.

2. Description of the Related Art

Subterranean deposits of coal may contain substantial quantities of entrained fluid, such as methane gas, oil and water. The entrained gas and liquid can be safety hazards for coal mining, especially the methane gas. The removal of entrained gas and liquid can make the coal mining safer and more productive. Although methane gas poses safety concerns in coal mining operations, it is actually one of the cleanest fuels available. Its demand has been increasing steadily. In recent years, methane gas removed from coal deposits has become a useful product in it own right or even a main product. Substantial obstacles, however, have frustrated more extensive development and use of methane gas deposits in coal seams. The foremost problem in producing methane gas from coal seams is that while coal seams may extend over large areas of up to several thousand acres, the coal seams are fairly thin, varying from a few inches to several meters. Thus, while the coal seams are often relatively near the surface, vertical wells drilled into the coal deposits for obtaining methane gas can only drain a fairly small radius around the coal deposits. Further, coal deposits are not amendable to pressure fracturing and other methods often used for increasing methane gas production from rock formations. As a result, once the gas easily drained from a vertical well bore in a coal seam is produced further production is limited.

Additionally, coal seams are often associated with subterranean water, which must be drained from the coal seam at the time the methane is mined. The separation of gas (mostly methane) and liquid (mostly water) is necessary for efficient production or removal of either one.

Horizontal drilling patterns have been tried in order to extend the amount of coal seams exposed to a drill bore for gas extraction. A root type or a pinnate type pattern is generally used. A vertical well located at the center of the pattern, with main bores/branches radiating outwards. Each main bore may in turn have branches to fill the space in between the main bores.

Gases in coal seam may be produced or removed prior to coal mining operation. Vertical well and horizontal bores are drilled. Many of the existing drilling patterns require drilling of several vertical wells in cooperation with horizontal bores in addition of main vertical well. Many of the patterns in the art are not flexible enough to be useful for various field conditions.

It is desirable to have a method and a system to improve the drainage pattern such that the number of vertical wells for a particular field is reduced and the drainage from such field is improved.

BRIEF SUMMARY OF THE INVENTION

The present invention uses a primary well and a secondary well. The primary well has a vertical section and substantially horizontal section. The horizontal section forms a root pattern, with main bores and side branches. From each main bore, there is one side branch that will convene at a common location. The common location where the side branches convene is deeper than all other main bores or their side branches, which are substantially horizontal. At the common location, a secondary vertical well is drilled. Liquid and gas from all branches will flow to the common location by gravity and/or pressure and thereafter removed through the secondary vertical well.

BRIEF DESCRIPTION OF THE SEVERAL VIEWS OF THE DRAWINGS

A better understanding of the invention can be had when the following detailed description of the preferred embodiments is considered in conjunction with the following drawings, in which.

DETAILED DESCRIPTION OF THE INVENTION

Figure 1:
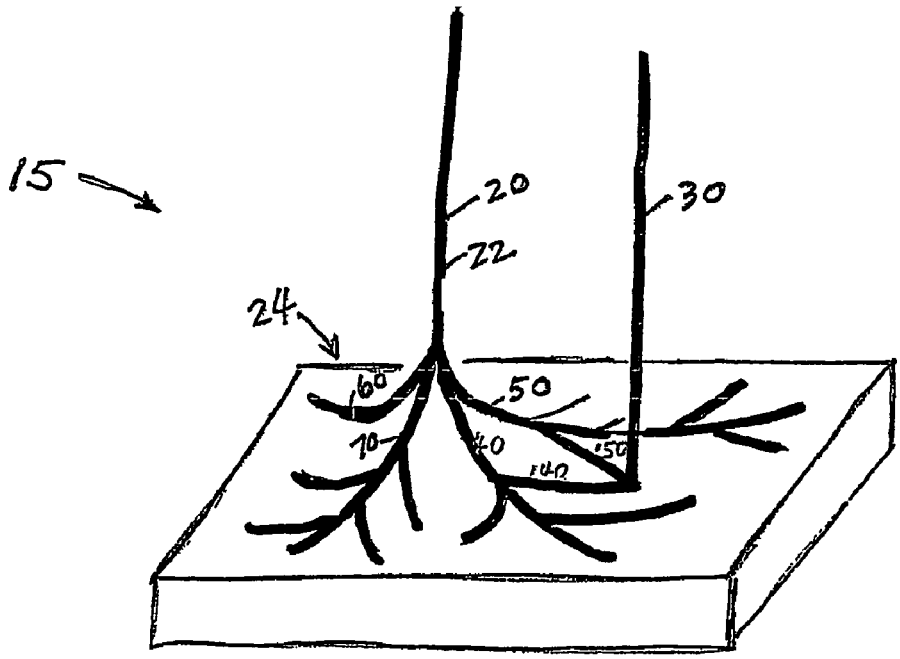
FIG. 1 a perspective view depicting the overall drainage system with a primary well, a secondary well and a horizontal drainage branches.

FIG. 1 depicts an overall system 15 for underground fluid collection, and production/removal. As used in coal seam gas production or coal mining degasification, a primary well 20 and a secondary well 30 may be drilled In certain coal fields, the vertical sections of one or both wells may be existing wells. The primary well 20 has a vertical section 22 and a substantially horizontal section 24. The primary well 20 is used primarily for fluid collection. The horizontal section 24 is a fluid communication and transportation network, similar to a root system for a tree or the veins in a tree leaf. The horizontal section has several main bores 40, 50, 60 etc. Each main bore has a plurality of branches to get into a larger area to increase the contact surface areas between the horizontal section and the fluid bearing formation. The fluid entrained in the surrounding area in the coal seam or other formation will migrate into the branches, due to the gas partial pressure difference and/or gravity. Once the fluid gets into the horizontal branches, its mobility is enhanced greatly and will freely move to a location where the partial pressure is lower or the elevation is lower. As to coal seam gas production, the gas bearing formation is the coal seam, which is often relatively thin, ranging from less than a foot to tens of feet. The horizontal section of well bores is substantially confined in that coal seam. The elevation of the horizontal section depends largely on the elevation of the coal seam formation which is substantially flat or varying gradually in a typical coal field.

Figure 2:
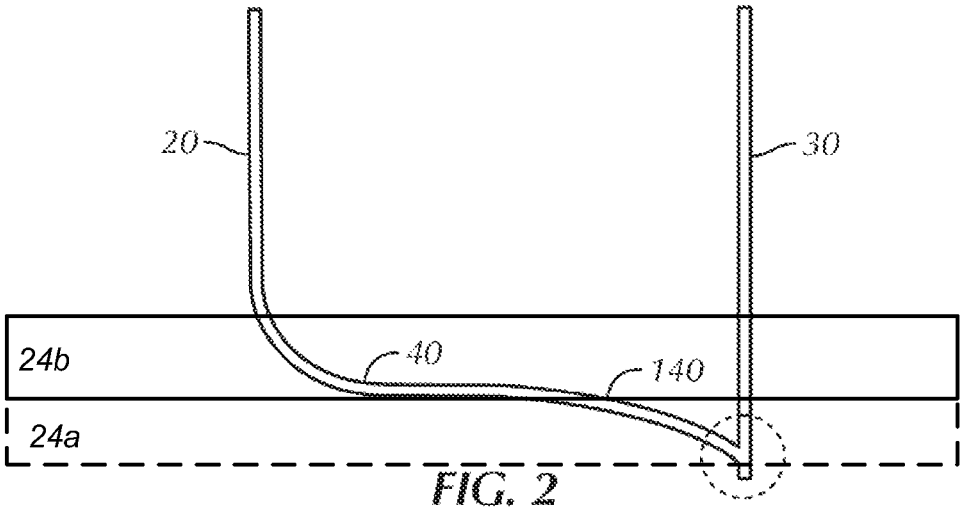
FIG. 2 is an elevation view depicting the relative elevation of primary well and the secondary well with connecting branches.

Referring now to FIG. 2, from a main bore or a branch, a C-branch may be drilled. A C-branch is same as any other branches and may be drilled by the same drilling rig. The only difference is that a C-branch is not substantially horizontal. A C-branch is typically inclined. A C-branch will start from a main bore or a branch and terminate at a vicinity of common location. A C-branch may 24*a* or may not 24*b* be confined within the coal seam. Typically, a C-branch is not confined within the coal seam 24*b*, where other main bores or horizontal branches are typically confined in the coal seam. The elevation of the beginning of the C-branch is the same as the most parts of the horizontal section, but the elevation of the ending of the C-branch is typically lower than the rest of the horizontal section 24*b*, such that the fluid in main bores or branches tends to flow towards the ending of the C-branch. Once the horizontal section with transportation network is formed and the common location is determined, a secondary well 30 is drilled at the common location or an existing vertical well at the common location is utilized. The bottom of the secondary well 30 is at or slightly below the ends of the C-branches which convene there. The ends of C-branches may intersect the secondary well as in the alternative may merely terminate in the vicinity of the secondary well. In typical drilling operations and typical underground formation of the C-branch terminates in the vicinity of a drilled well, the well bore is likely fractured, i.e. permeable to fluid. Therefore, it is often unnecessary for the ends of C-branches to intersect with the secondary well. There will be sufficient communication between the C-branches and the secondary well 30 for fluid to freely move between C-branches, the horizontal section 24 of primary well 20 and the secondary well 30. The permeable formation surrounding the secondary well 30 may act as a filter to screen out debris from reaching the secondary well 30 and the pumping devices.

Figure 5:
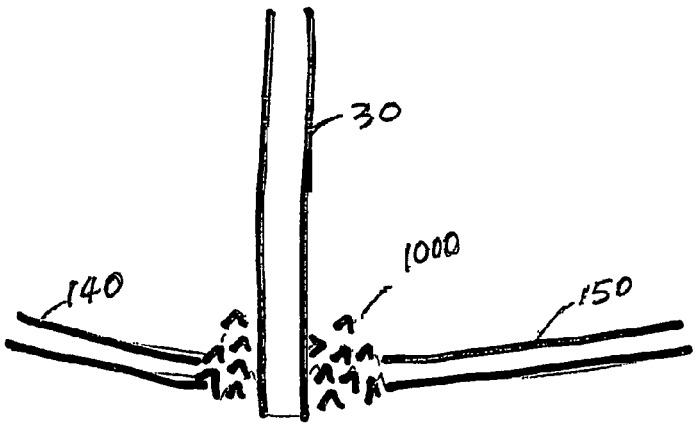
FIG. 5 depicts the details around the intersection of secondary well and the convening branches without direction connections between the secondary well and the convening branches.
Figure 6:
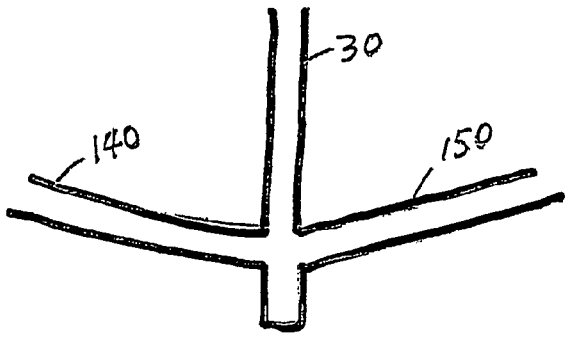
FIG. 6 depicts an alternative to the system in FIG. 5, where the branches are directly connected to the secondary well.

FIG. 2 depicts more details regarding the elevation relationship between the primary well 20, secondary well 30 and horizontal main bore 40 and C-branch 140. Related FIGS. 5 and 6 depict the common location where ends of C-branches and bottom of secondary well 30 convene. Typically, the vertical section 22 of the primary well 20 curves above the coal seam and turns into horizontal main bore 40. The C-branch 140 starts out from main bore 40, which is at the same elevation as most other parts of the horizontal section, ends at the common location, at a lower elevation. The bottom of the secondary well 30 is at the same vicinity. All the C-branches and the secondary well 30 may be interconnected to each other at the common location as shown in FIG. 6. C-branch 140 and C-branch 150 are connected to the secondary well 30 at a similar elevation. Fluids collected by the horizontal well bores are transported by C-branches to the bottom of secondary well 30 and may thereafter be removed. Alternatively, the C-branches may simply end at a vicinity of the common location as shown in FIG. 5, without actually interconnecting with each other. As shown in FIG. 5, after drilling of C-branches, e.g. 140, secondary well 30, the vicinity at common location 1000 that may have been fractured and permeable to fluid. These fractures may happen during the drilling of either the secondary well 30 or the C-branches or other branches nearby. The fluid in any of the well bores can communicate and flow to the secondary well 30 easily and freely. Beneficially, the fractured formation 1000 serves to block debris in one well bore from traveling to another or to the secondary well 30. If a sump pump is situated at the bottom of secondary well 30 for removing subterranean water, then debris from all horizontal section of the primary well 20 will be blocked by the filter effect of the fractured formation. The distance between the secondary well 30 and the C-branch ends may be as close as a few inches, e.g. one inch or as large as tens of feet, e.g. 90 feet depending on the permeability of the material between the terminus of C-branch 140 and secondary well 30. The diameters of the wells and well bores are in the range of several inches to a few feet. Typical well bores are 6 to 10 inches in coal seam methane production.

Figure 3:
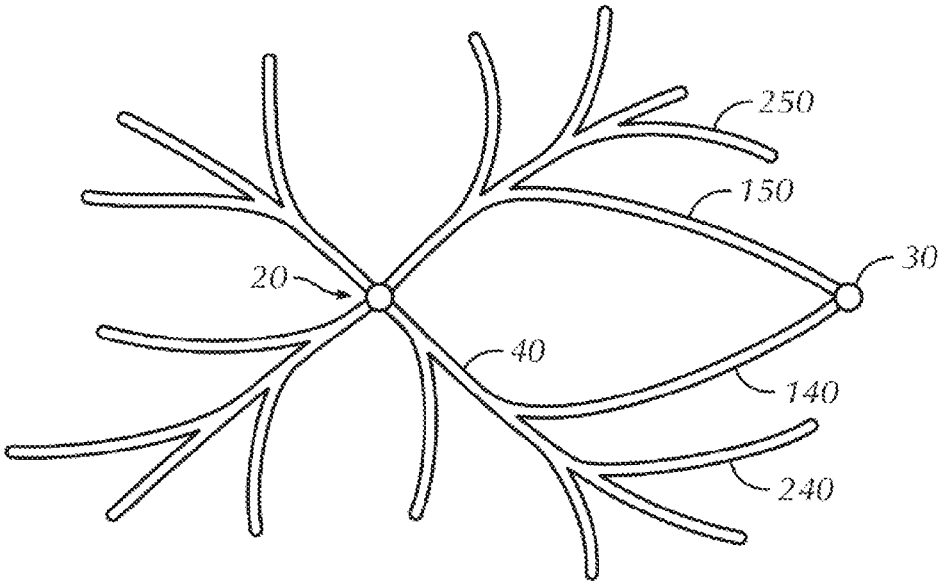
FIG. 3 is a plane view depicting the horizontal projection and the interconnection of horizontal well bore branches.

FIG. 3 depicts a horizontal projection of the horizontal section of the primary well 20. The vertical section 20 is at the center of the whole system. The main bores, e.g. 40, 50 and etc., radiate outwards to the boundaries of the coal field so as to cover the whole coal field. Each main bore has a plurality of branches, e.g. 240, 250 etc., to provide better coverage in between the main bores. Several C-branches convene at the vicinity of the secondary well 30.

Figure 4:
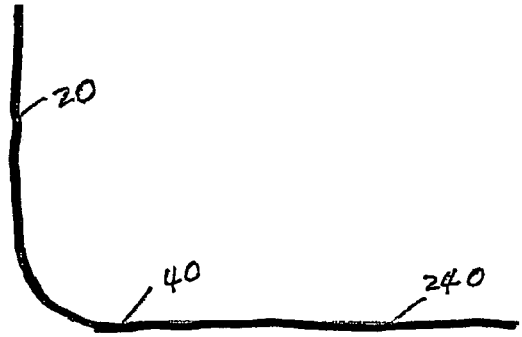
FIG. 4 is an elevation view depicting the primary well and one of the main horizontal main bores.

FIG. 4 depicts the elevational relationships of the various sections of the primary well 20. The vertical section 20 is substantially straight and vertical. It curves near the target coal seam and becomes a horizontal section, a main bore 40. The main bore 40 extends outwards within the coal seam, substantially in the same elevation. A branch 240, which is substantially at the same depth, is shown in FIG. 4.

Figure 7:
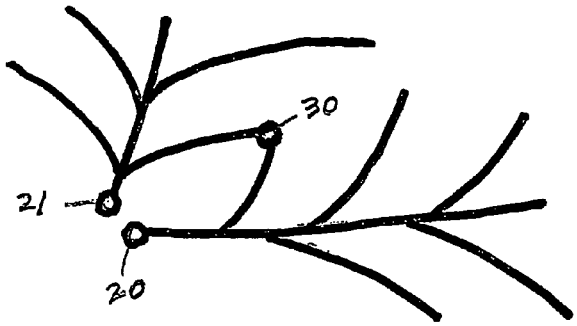
FIG. 7 is a plane view depicting the horizontal projection of an alternative system.

FIG. 7 depicts an alternative embodiment of the current invention. Instead of sharing a common vertical section of the primary well with different horizontal main bores, in this alternative, each main bore 20 and 21 has its own vertical well not show in FIG. 7. In this arrangement, the vertical wells and the horizontal main bores can be drilled simultaneously and independently. The C-branches still convene at a common location and a common secondary well 30 is drilled to collect the liquid or gas.

Figure 8:
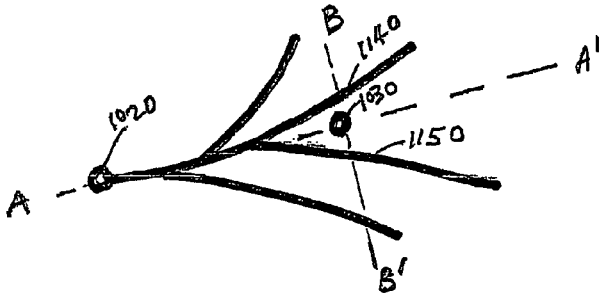
FIGS. 8-10 depict an alternative system where horizontal branches bypass the vicinity of the secondary well.
Figure 9:
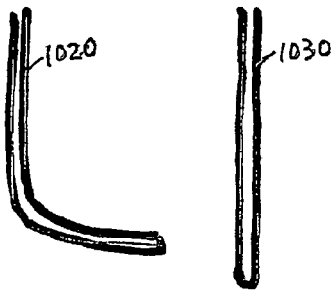
Figure 10:
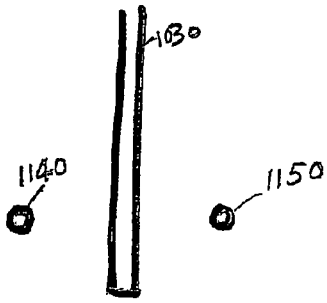

FIGS. 8, 9 and 10 further illustrate the liquid collection system where the secondary well 1030 is not directly connected to the branches or main bores of the primary well 1020. FIG. 8 is a horizontal projection of the system, where primary well 1020 has a horizontal section with main bores and branches, e.g. 1140 and 1150. The secondary well 1030 is located at the vicinity of branches 1140 and 1150 but not directly connected to either of the branches. Due to the drilling operation of the secondary well 1030, branches 1140 or 1150, or their combination, the underground area in the vicinity of branches 1140 and 1150 are fractured, or generally permeable to fluids. Therefore any fluid in branches 1140 and 1150 may flow into the secondary well 1030. FIGS. 9 and 10 show the vertical cross-section along the line A-A' and B-B', illustrate the vertical or elevation relationship between the secondary well and the branches. As shown in FIG. 9, the primary well 1020 has a vertical section, a curve and then a horizontal section. The horizontal main bore branch extends from the primary well 1020 towards the secondary well 1030. The main bore then bends and through the vicinity of the secondary well 1030. FIG. 10 shows the branches 1140 and 1150 pass the vicinity secondary well 1030. The two branches 1040 and 1050 have a higher elevation than the bottom of the secondary well 1030.

Figure 11:
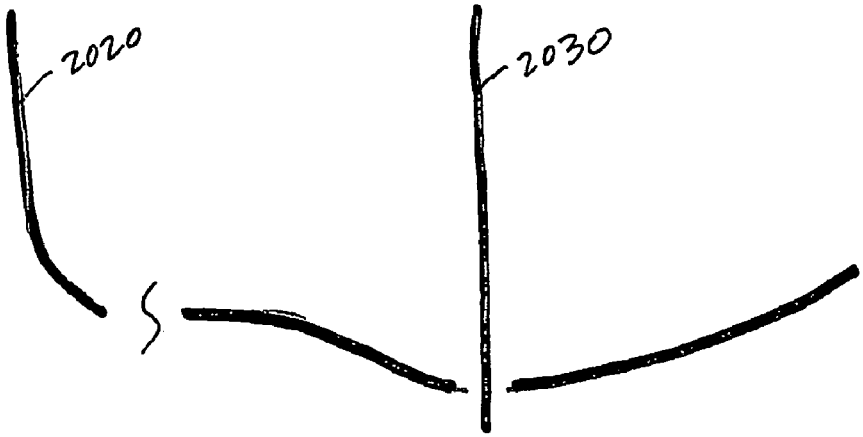
FIGS. 11-15 depict alternative fluid collection systems.
Figure 12:
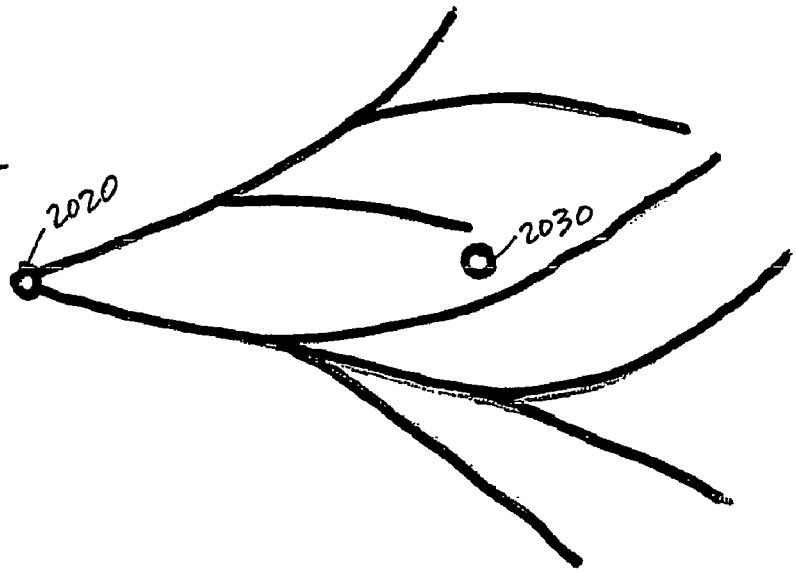

FIGS. 11-16 depict alternative systems for fluid collection. FIGS. 11 and 12 show the vertical projection and horizontal projection of a system. The secondary well 2030 is at or near a minimum elevation of a coal bed. The primary well 2020 is at a higher elevation of the coal bed, such that the horizontal section of the primary well 2020 bypasses the secondary well

2030. The fluid collected by the horizontal section of primary well 2020 will flow towards the low point at secondary well 2030.

Figure 13:
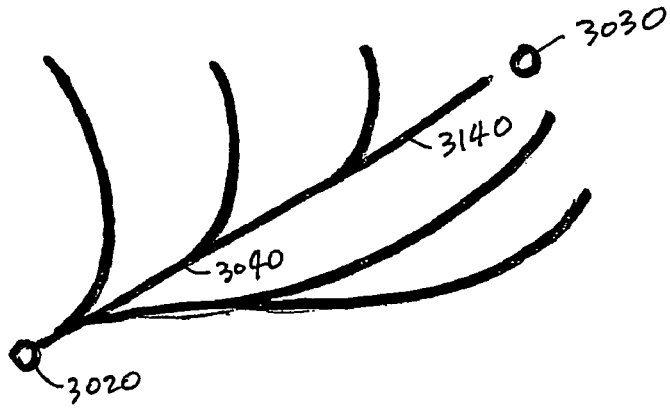
Figure 14:
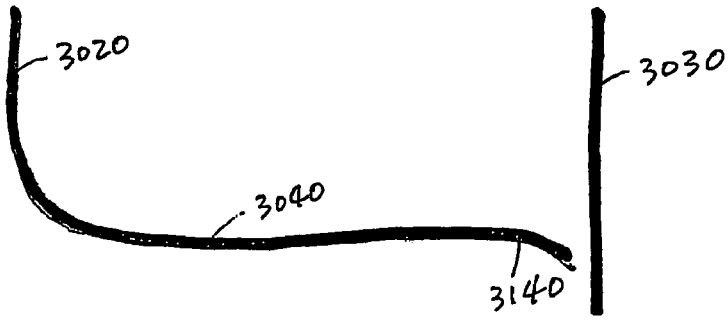

FIGS. 13 and 14 depict another alternative system, where the coal bed goes slightly down hill from the primary well 3020 to the secondary well 3030. FIG. 13 shows the horizontal projection and the FIG. 14 shows the vertical projection. The horizontal branch 3040 goes slightly downward from primary well 3020 to secondary well 3030 and the C-branch 3140 further the vicinity of secondary well 3030.

Figure 15:
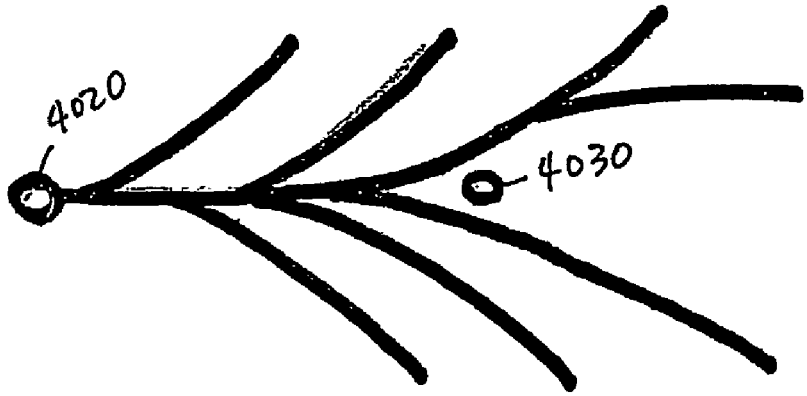

FIG. 15 depicts approaches the horizontal projection of an alternative system. The horizontal branches from the primary well 4020 splits near the secondary well 4030 and bypasses the secondary well 4030.

The locations of the primary well and the secondary well may be independent from each other. They can be very close to each other, e.g. 300 ft or far away, e.g. 2000 ft or 4000 ft, at the opposite end of a coal field. Relative locations are determined to form a best gas collection/liquid drainage pattern. If there are existing vertical wells in a coal field, then those wells may used as the primary or secondary wells and be modified to suit the new needs. The flexibility of the location of the primary and secondary wells make the current fluid collection pattern more efficient and more economical than existing fluid collection methods. For example, in a coal field where the coal bed is sloped towards one side, then the secondary well may be located at the lowest edge of the coal seam while the primary well may be located at the highest edge of the coal seam, such that water can drain towards the secondary well. Water collected may thereafter be pumped out of the coal seam.

If the coal seam has both an uphill and a downhill slope, then the secondary well may be located at the valley of the coal seam, for example as shown in FIGS. 11 and 12.

C-branch is used primarily to transport the fluid collected from the coal seam in the main bores and branches in the horizontal well bore. C-branch has a different functionality compared to other main bores and branches, which are used for collecting fluid from coal seam. Therefore, C-branches are not confined within the coal seam. Therefore, C-branches may be sloped from the substantially horizontal well bores of main bores and branches towards a lower elevation at the secondary well, to serve as a sink for fluid, where the collected fluid may thereafter be removed from the site. C-branch sloping patterns provide and make the fluid collection and removal more efficient and effective.

Unlike prior art drainage patterns, where each main bore has a vertical well for liquid collection and removal, according to the current invention, the secondary well may be shared among two or more main bores. Thus the number of vertical wells is reduced.

In some large fields as shown in FIG. 3, the primary well 20 is at the center of the field, or the main bores radiate outwards to the edge of the field.

While illustrative embodiments of the invention have been depicted and described, it will be appreciated that various modifications and improvements may be made without departing from the spirit and scope of the invention.

What is claimed is:

1. A method for collecting and removing fluid from underground deposits, the method comprising:

drilling a first, substantially vertical well;

drilling a substantially horizontal well with at least one main bore from the first substantially vertical well;

drilling a plurality of branches in the horizontal plane from a main bore;

drilling a second, substantially vertical well deeper than all the main bores and branches of the horizontal well; and drilling a C-branch from the main bore towards the second well, wherein the C-branch bypasses the second well at a minimum distance d.

2. The method in claim 1, wherein the minimum distance d ranges 1 inch to 100 feet.

3. The method in claim 1, further comprising:

removing fluid from the second well.

4. The method in claim 3, wherein the fluid removed from the second well is water or gas.

5. The method in claim 1, wherein the distance between the first well and the second well ranges from 300 feet to 4000 feet.

6. A method for collecting and removing fluid from underground fluid deposits, the method comprising:

drilling a first, substantially vertical well;

drilling a substantially horizontal well with at least one main bore from the first substantially vertical well;

drilling a plurality of branches in the substantially horizontal plane from the main bore;

drilling a second, substantially vertical well at the vicinity of the main bore or a branch, wherein the minimum distance between the second well and the branch or the main bore is about 1 inch to about 100 feet, wherein the bottom of the second well is deeper than all the main bores and branches.

7. The method in claim 6, wherein the horizontal distance between the second well and the vertical section of the first well ranges from 300 feet to 4000 feet.

8. The method in claim 6, farther comprising:

fracturing the strata between the second well, and the branch or the main bore.

9. A well system for underground fluid collection and removal, the system comprising:

a first well having a substantially vertical section and a substantially horizontal section;

wherein the substantially horizontal section comprises at least one main bore and a plurality of branches;

wherein the main bore further has a C-branch;

a second well having a substantially vertical section wherein the bottom of the second well is lower than any main bores or branches;

wherein the C-branch inclines downward towards the second well and terminates at the vicinity of the second well.

10. The well system in claim 9, wherein the C-branch connects to the second well.

11. The well system in claim 9, wherein the minimum distance d between the C-branch and the second well is greater than zero.

12. The well system in claim 11, wherein the minimum distance d ranges from 1 inch to 100 feet.

13. The well system in claim 9, wherein the first well and the second well are in a coal field, and wherein substantially all main bores and branches of the horizontal section are in a coal seam except the C-branch.

14. The well in claim 9, wherein the horizontal distance between the vertical section of the first well and the second well ranges from 300 ft to 4000 ft.

15. The well system in claim 9, further comprising:

a third well having a substantially vertical section and a substantially horizontal section;

wherein the substantially horizontal section comprising at least one main bore and a plurality of branches;

wherein the main bore further has a second C-branch;

wherein the second C-branch inclines downward towards the second well and terminates at the vicinity of the second well.

16. The well system in claim 15, wherein the first well, the second well and the third well are in a coal field, and wherein substantially all main bores and branches of the horizontal section are in a coal seam except the C-branch and the second C-branch.

17. The well in claim 15, wherein the horizontal distance between the vertical section of the third well and the second well ranges from 300 ft to 4000 ft.

18. A method for collecting and removing fluid from underground deposits, the method comprising:

drilling a first, substantially vertical well;

drilling a substantially horizontal well with at least one main bore from the first substantially vertical well;

drilling a plurality of branches in the horizontal plane from a main bore;

drilling a second, substantially vertical well deeper than all the main bores and branches of the horizontal well; and drilling a C-branch from the main bore towards the second well, wherein the C-branch intersects the second well.

19. The method in claim 18, wherein the distance between the first well and the second well ranges from about 300 feet to about 4000 feet.

20. The method in claim 18, further comprising removing fluid from the second well.

21. The method in claim 20, wherein the fluid removed from the second well is water or gas.

22. A method for collecting and removing fluid from underground deposits, the method comprising:

drilling a first, substantially vertical well;

drilling a substantially horizontal well with at least one main bore from the first substantially vertical well;

drilling a plurality of branches in the horizontal plane from a main bore;

drilling a second, substantially vertical well deeper than all the main bores and branches of the horizontal well; and drilling a C-branch from the main bore towards the second well, wherein the C-branch terminates at a distance d from the second well.

23. The method in claim 22, farther comprising removing fluid from the second well.

24. The method in claim 23, wherein the fluid removed from the second well is water or gas.

25. The method in claim 20, wherein the distance between the first well and the second well ranges from about 300 feet to about 4000 feet.

* * * * *